US009844942B2

(12) United States Patent
Hasegawa

(10) Patent No.: US 9,844,942 B2
(45) Date of Patent: Dec. 19, 2017

(54) RECORDING APPARATUS

(71) Applicant: SEIKO EPSON CORPORATION, Tokyo (JP)

(72) Inventor: Ryo Hasegawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/005,308

(22) Filed: Jan. 25, 2016

(65) Prior Publication Data

US 2016/0214387 A1 Jul. 28, 2016

(30) Foreign Application Priority Data

Jan. 28, 2015 (JP) ..... 2015-014093

(51) Int. Cl.
*B41J 2/165* (2006.01)

(52) U.S. Cl.
CPC ..... *B41J 2/16535* (2013.01); *B41J 2/16517* (2013.01); *B41J 2/16538* (2013.01); *B41J 2/16544* (2013.01)

(58) Field of Classification Search
CPC ..... B41J 2/16535; B41J 2/16544; B41J 2/16517; B41J 2/16538
See application file for complete search history.

(56) References Cited

U.S. PATENT DOCUMENTS 6,206,499 B1 * 3/2001 Iijima ..... B41J 2/14024 347/20
2006/0087530 A1 * 4/2006 Furukawa ..... B41J 2/16538 347/33
2014/0198155 A1 7/2014 O'Hara et al.

FOREIGN PATENT DOCUMENTS

JP 06-115065 A 4/1994
JP 2007 261258 10/2007
JP 2010 099880 5/2010
JP 2014-046502 A 3/2014

OTHER PUBLICATIONS

European Search Report for Application No. 16153211.4 dated Aug. 5, 2016.

* cited by examiner

*Primary Examiner* — Justin Seo
(74) *Attorney, Agent, or Firm* — Workman Nydegger

(57) ABSTRACT

A recording apparatus includes a recording head capable of moving back and forth relative to a recording medium and ejecting a liquid from a nozzle, a cover portion that covers at least a portion of a no-nozzle-formed region in which the nozzle is not formed within a nozzle-formed surface in which the nozzle is formed, and a wiper provided in a back-and-forth movement range of the recording head and capable of wiping the cover portion without contacting the nozzle-formed surface as the recording head moves back and forth.

11 Claims, 6 Drawing Sheets

RECORDING APPARATUS

BACKGROUND

1. Technical Field

The present invention relates to a recording apparatus.

2. Related Art

Recording apparatuses that have a recording head that performs recording by ejecting a liquid such as ink from nozzles onto a recording medium while moving the recording head back and forth relative to the recording medium have been used. In these recording apparatuses, recording quality sometimes declines due to mist produced as the recording head ejects the liquid. Therefore, many recording apparatuses in use are equipped with a wiper that wipes such mist.

For example, JP-A-6-115065 and JP-A-2014-46502 disclose recording apparatuses each equipped with a wiper capable of wiping a nozzle-formed surface in which nozzles are formed.

However, when the nozzle-formed surface is wiped, mist or the like deposited on the nozzle-formed surface may be pushed into nozzles, so that recording quality may sometimes decline. In order to inhibit such decline in recording quality, it is necessary to interrupt a recording operation even during recording and execute a cleaning operation of discharging mist or the like pushed in nozzles.

Thus, in the related-art recording apparatuses, the recording speed needs to be reduced in order to inhibit decline in recording quality due to mist produced as the recording head ejects liquid.

SUMMARY

An advantage of some aspects of the invention is that it becomes possible to inhibit the recording quality from declining due to mist produced as the recording head ejects liquid, without reducing the recording speed.

A recording apparatus according to an aspect of the invention includes a recording head capable of moving back and forth relative to a recording medium and ejecting a liquid from a nozzle, a cover portion that covers at least a portion of a no-nozzle-formed region in which the nozzle is not formed within a nozzle-formed surface in which the nozzle is formed, and a wiper provided in a back-and-forth movement range of the recording head and capable of wiping the cover portion without contacting the nozzle-formed surface as the recording head moves back and forth.

In this recording apparatus, the cover portion may have higher liquid repellency to the liquid than the wiper does.

In the foregoing recording apparatus, the liquid repellency of the cover portion to the liquid may be higher in a region near the nozzle than in a region remote from the nozzle.

In the foregoing recording apparatus, the wiper may be a blade that extends in a direction that intersects reciprocating directions of the recording head.

In the foregoing recording apparatus, in the nozzle-formed surface, a plurality of the nozzle may be arranged in a direction that intersects reciprocating directions of the recording head. Furthermore, the wiper may be capable of wiping in a direction that intersects the reciprocating directions of the recording head.

In the foregoing recording apparatus, the wiper may be made of a material capable of absorbing the liquid.

In the foregoing recording apparatus, the wiper may be capable of being withdrawn from a location at which the wiper is able to wipe the cover portion as the recording head moves back and forth.

In the foregoing recording apparatus, ratio of a thickness of a cover region in the cover portion which covers the nozzle-formed surface to a length of an exposed region in the nozzle-formed surface which is not covered with the cover portion, the length being measured in reciprocating directions of the recording head, may be greater than or equal to 0.02 and less than or equal to 3.0.

In the foregoing recording apparatus, the ratio of the thickness of the cover region to the length of the exposed region may be greater than or equal to 0.5 and less than or equal to 2.4.

The foregoing recording apparatus may further include a transport portion that transports the recording medium in a direction that intersects reciprocating directions of the recording head, and the wiper may be provided at an end portion of a transport region in which the recording medium is transported by the transport portion, the end portion being at an end in one of the reciprocating directions.

In the foregoing recording apparatus, the wiper may be provided at each of two end portions of the transport region in the reciprocating directions.

According to the invention, it is possible to inhibit the recording quality from declining due to mist produced as the recording head ejects liquid without reducing the recording speed.

DESCRIPTION OF EXEMPLARY EMBODIMENTS

Exemplary Embodiment 1 (FIG. 1 to FIG. 6)

Recording apparatuses according to exemplary embodiments of the invention will be described in detail hereinafter with reference to the accompanying drawings.

First, a recording apparatus 1 according to Exemplary Embodiment 1 of the invention will be generally described.

Figure 1:
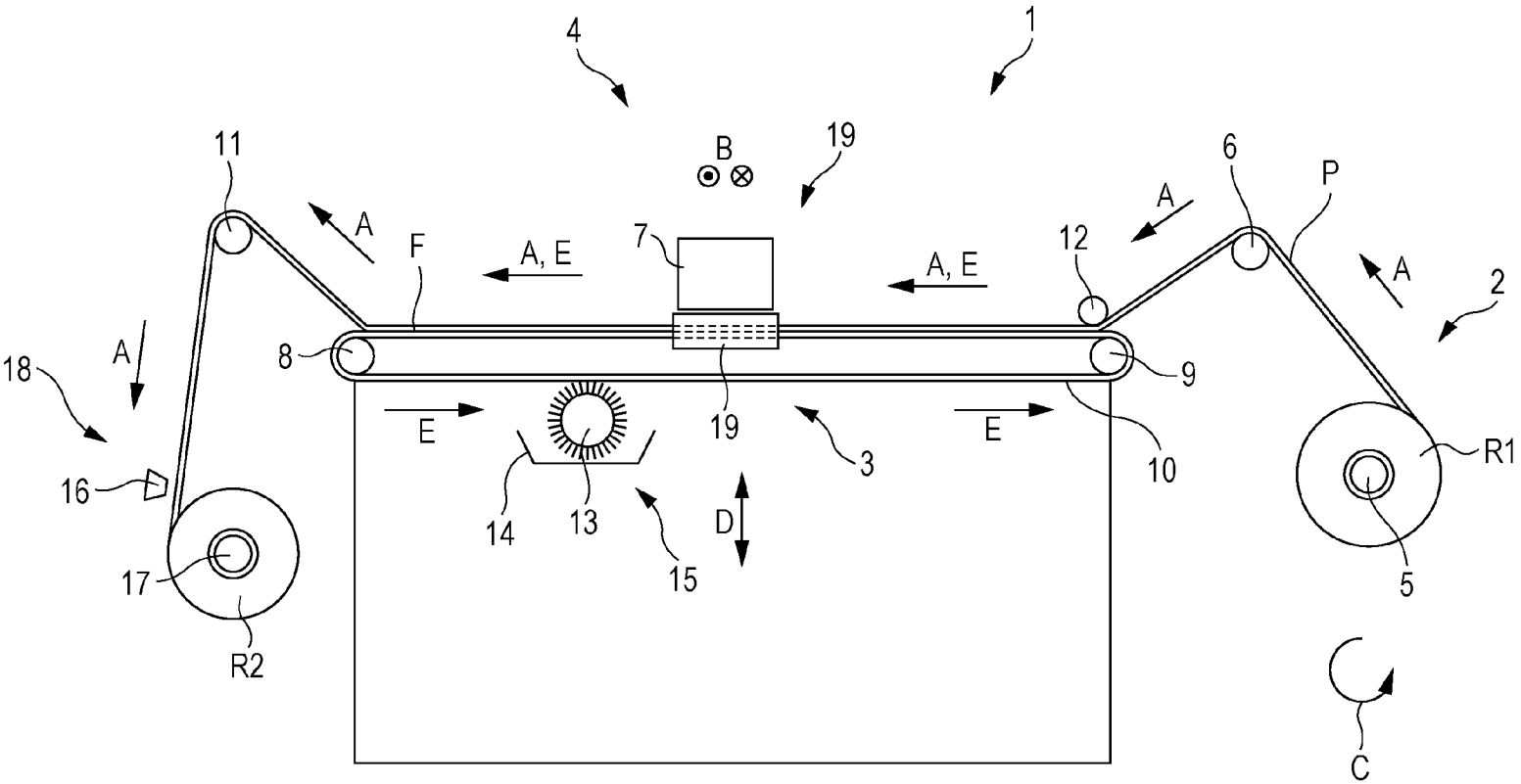
FIG. 1 is a schematic side view presenting a recording apparatus according to Exemplary Embodiment 1 of the invention.
Figure 2:
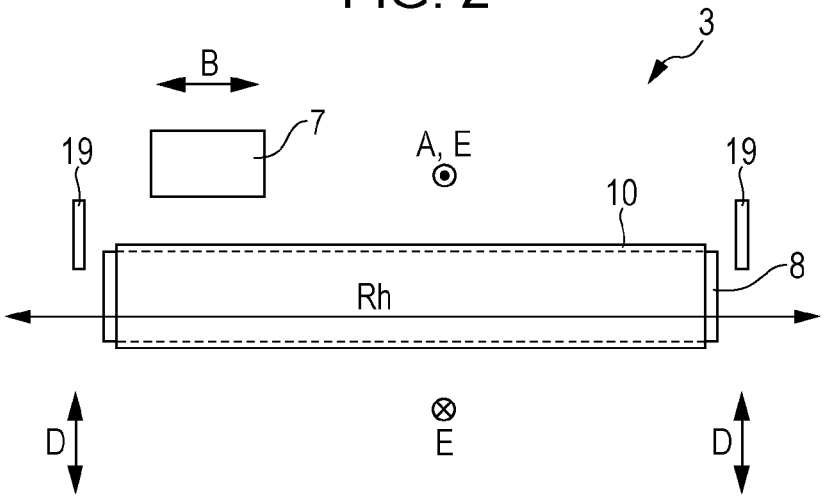
FIG. 2 is a schematic front view presenting the recording apparatus of Exemplary Embodiment 1 of the invention.
Figure 3:
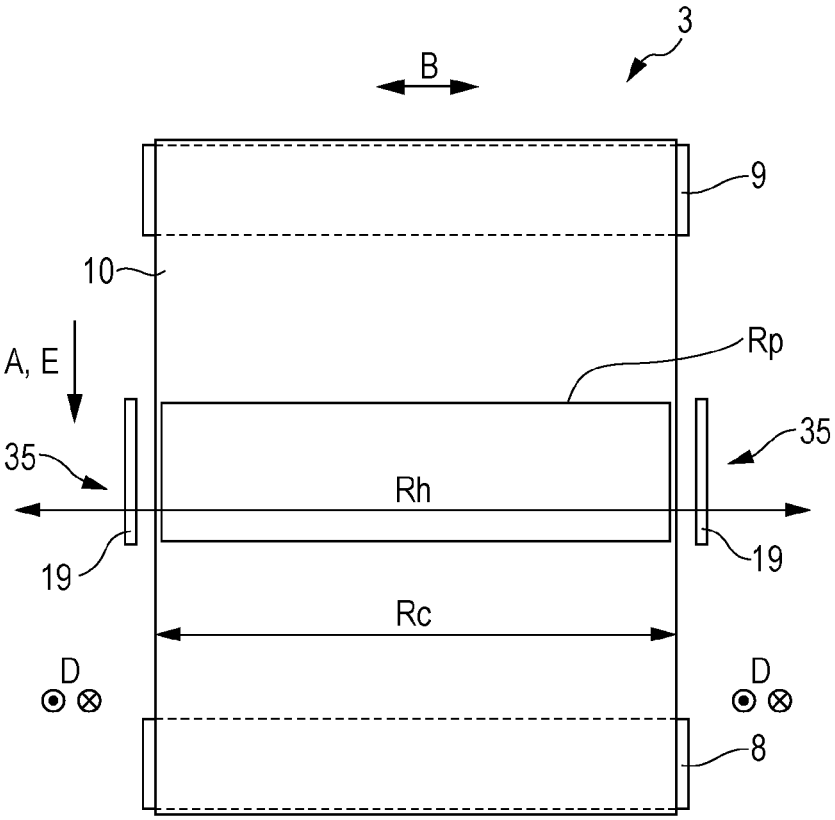
FIG. 3 is a schematic plan view presenting the recording apparatus of Exemplary Embodiment 1 of the invention.

FIG. 1 is a schematic side view of the recording apparatus 1 of this exemplary embodiment. FIG. 2 and FIG. 3 are schematic diagrams of portions in and around a transport mechanism 3 that transports a recording medium P and that is equipped with wipers 19 that are portions of the recording apparatus 1 of this exemplary embodiment. FIG. 2 is a schematic front view and FIG. 3 is a schematic plan view.

As presented in FIG. 1, the recording apparatus 1 of this exemplary embodiment includes a feeder portion 2 capable of feeding the recording medium P on which to perform recording by unwinding a roll R1 of the recording medium P. The recording apparatus 1 further includes a transport mechanism 3 as a transport portion that transports the recording medium P in a transporting direction A by a adhesive belt 10 that supports the recording medium P on a support surface F that has a tackiness agent thereon. There is further provided a recorder mechanism 4 that performs recording on the recording medium P by moving a recording head 7 back and forth in reciprocating directions B that intersect the recording medium P-transporting direction A. A washer mechanism 15 for the adhesive belt 10 is also provided. Furthermore, a winder mechanism 18 having a winding shaft 17 that winds up the recording medium P and a cutter 16 that cuts the recording medium P wound around the winding shaft 17 is provided.

The feeder portion 2 includes a rotation shaft 5 on which the roll R1 of the recording medium P for recording is set, and is capable of feeding the recording medium P from the roll R1 set on the rotation shaft 5 to the transport mechanism 3 via a driven roller 6. Incidentally, when the recording medium P is fed to the transport mechanism 3, the rotation shaft 5 rotates in a rotation direction C.

The transport mechanism 3 includes the adhesive belt 10 that supports and transports thereon the recording medium P fed from the feeder portion 2, a transport roller 8 provided as a driving roller that moves the adhesive belt 10, and a driven roller 9. The recording medium P is mounted on and stuck to a support surface F of the adhesive belt 10 by a pressure roller 12 pressurizing the recording medium P onto the support surface F. To transport the recording medium P, the transport roller 8 rotates in the rotation direction C so that the adhesive belt 10 moves in a direction E.

However, the transport belt is not limited to a adhesive belt. For example, an electrostatic adsorption type transport belt may be used.

The recorder mechanism 4 includes the recording head 7 capable of ejecting ink (liquid) from nozzles N (see FIGS. 5A and 5B and FIG. 6) and a carriage motor 30 (see FIG. 4) that moves a carriage on which the recording head 7 is mounted back and forth in the reciprocating directions B relative to the recording medium P. Note that in FIG. 1, the reciprocating directions B are directions perpendicular to the sheet of the drawing.

During recording, the recording head 7 is moved back and forth for recording. However, during scanning for recording (moving the recording head 7), the transport mechanism 3 avoids transporting the recording medium P. In other words, during recording, the back and forth movements of the recording head 7 and the transport of the recording medium P are alternately performed. Specifically, during recording, the transport mechanism 3 intermittently transports the recording medium P (intermittently moves the adhesive belt 10) corresponding to the back and forth movements of the recording head 7.

As presented in FIG. 2 and FIG. 3, the wipers 19 are provided at two opposite end portions 35 of a recording region Rp of the recording head 7 in the reciprocating directions B. The recording region Rp is in a transport region Rc in which the recording medium P is transported by the transport mechanism 3.

Although detailed later, the recording apparatus 1 of this exemplary embodiment is configured to be capable of wiping the recording head 7 by the using wipers 19 during recording. The wipers 19 are movable in directions D and can be withdrawn so as to avoid contact with the recording head 7 during recording.

Although not shown in FIGS. 1 to 3, the recording apparatus 1 of this exemplary embodiment has a maintenance portion that includes a cap, wipers, a suction mechanism, etc., and that is capable of maintaining the recording head 7 when the recording head 7 is positioned at a home position.

The washer mechanism 15 for the adhesive belt 10 includes a washing brush 13 in which a plurality of washing rollers are connected in a rotation axis direction and a tray 14 that holds therein a detergent for washing the washing brush 13.

The winder mechanism 18 winds up the recording medium P that has been subjected to recording and transported from the transport mechanism 3 via a driven roller 11. A medium-winding paper tube or the like is set on the winding shaft 17, and the recording medium P is wound up as a roll R2 on the paper tube or the like.

Although the recording apparatus 1 of this exemplary embodiment is a recording apparatus in which a roll of the recording medium P is set and the recording medium P from the roll is supported and transported on the adhesive belt 10, this construction is not restrictive. For example, the recording apparatus of the invention may have a construction in which instead of a rolled recording medium P, a cut sheet-shaped recording medium P can be transported by a pair of rollers that constitute a transport portion and that clamp the recording medium P.

Next, an electrical construction of the recording apparatus 1 of this exemplary embodiment will be described.

Figure 4:
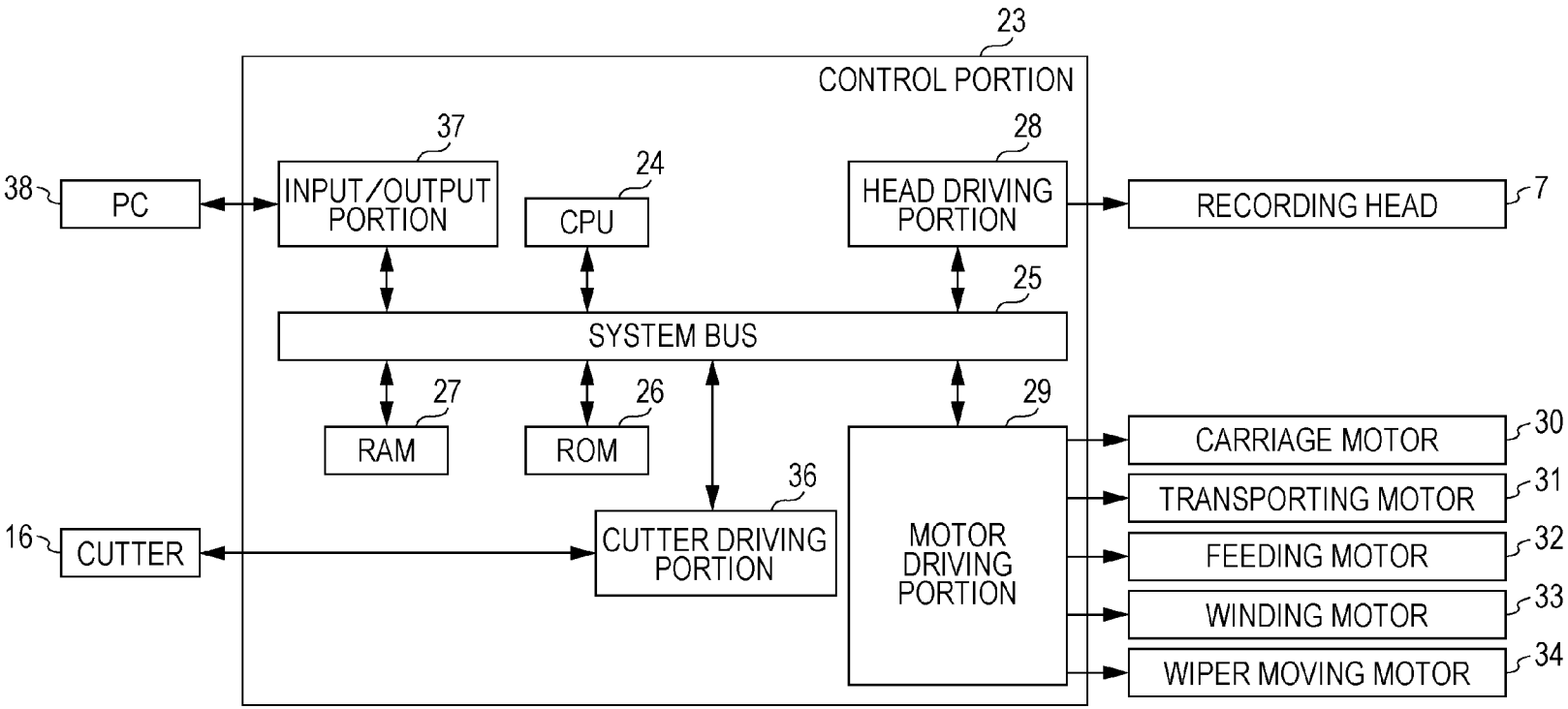
FIG. 4 is a block diagram presenting the recording apparatus of Exemplary Embodiment 1 of the invention.

FIG. 4 is a block diagram of the recording apparatus 1 of this exemplary embodiment.

A control unit 23 includes a CPU (central processing unit) 24 that performs overall control of the recording apparatus 1. The CPU 24 is connected via a system bus 25 to a ROM (read-only memory) 26 that stores various control programs that the CPU 24 executes and the like and a RAM (random access memory) 27 capable of temporarily storing data.

The CPU 24 is also connected via the system bus 25 to a head driving portion 28 that drives the recording head 7.

Furthermore, the CPU 24 is connected via the system bus 25 to a motor driving portion 29 that drives a carriage motor 30, a transporting motor 31, a feeding motor 32, a winding motor 33, and a wiper moving motor 34.

The carriage motor 30 is a motor that moves the carriage on which the recording head 7 is mounted. The transporting motor 31 is a motor that drives the transport roller 8. The feeding motor 32 is a motor that is a rotation mechanism for the rotation shaft 5 and that drives the rotation shaft 5 in order to feed the recording medium P to the transport mechanism 3. Besides, the winding motor 33 is a driving motor that rotates the winding shaft 17. The wiper moving motor 34 is a motor that moves the wipers 19 in the directions D.

The CPU 24 is also connected via the system bus 25 to a cutter driving portion 36 that drives the cutter 16 so that the cutter 16 cuts the recording medium P.

Furthermore, the CPU 24 is connected via the system bus 25 to an input/output portion 37. The input/output portion 37 is connected to a PC (personal computer) 38 that inputs recording data or the like from an external device or the like.

Next, a construction of the recording head 7 that is a portion of the recording apparatus 1 of this exemplary embodiment will be described.

Figure 5A:
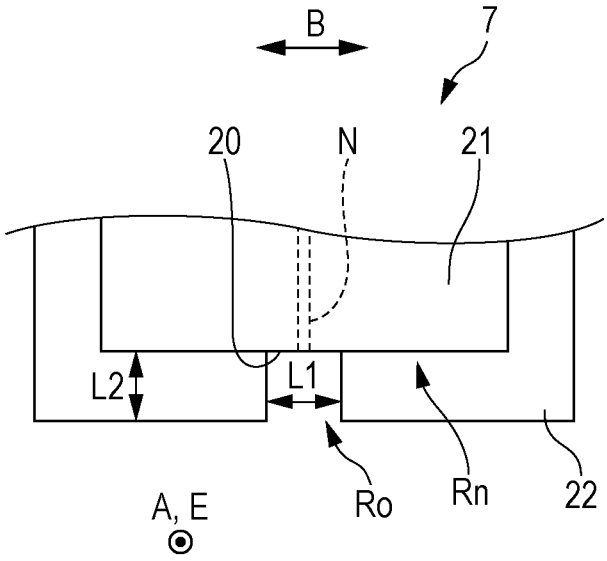
FIGS. 5A and 5B are schematic front views presenting portions of the recording apparatus of Exemplary Embodiment 1 of the invention.
Figure 5B:
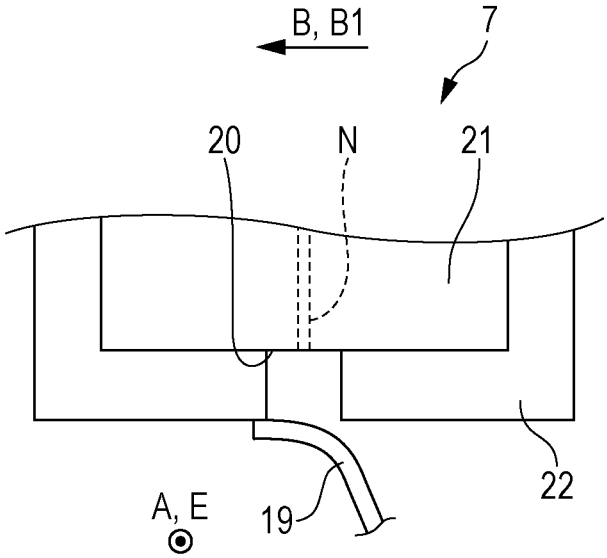

FIGS. 5A and 5B are schematic front views presenting the recording head 7 of this exemplary embodiment. FIG. 5A presents a state in which the recording head 7 is not in contact with either one of the wipers 19. FIG. 5B presents a state in which the recording head 7 is in contact with one of the wipers 19 when moving in a direction B1 that is one of the reciprocating directions B. Besides, FIG. 6 is a schematic bottom view presenting the recording head 7 of this exemplary embodiment.

Figure 8A:
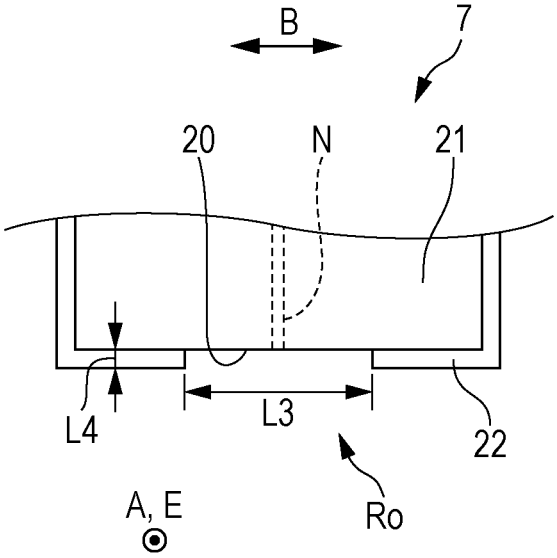
FIGS. 8A and 8B are schematic front views presenting portions of a related-art recording apparatus.
Figure 8B:
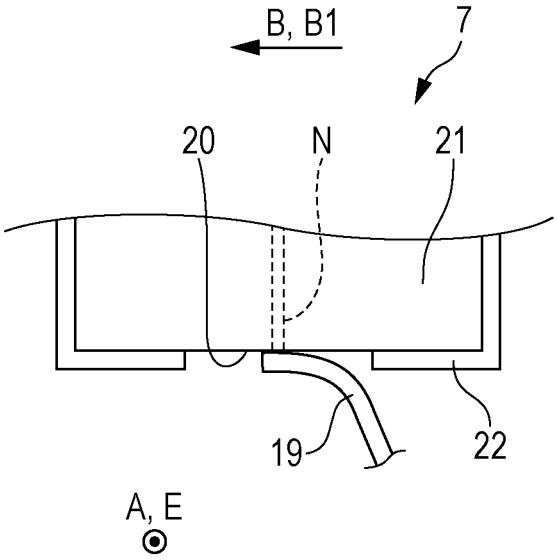

FIGS. 8A and 8B are schematic front views presenting a related-art recording head 7 and correspond to FIGS. 5A and 5B. FIG. 8A presents a state in which the recording head 7 is not in contact with either one of the wipers 19, and FIG. 8B presents a state in which the recording head 7 is in contact with one of the wipers 19.

Figure 6:
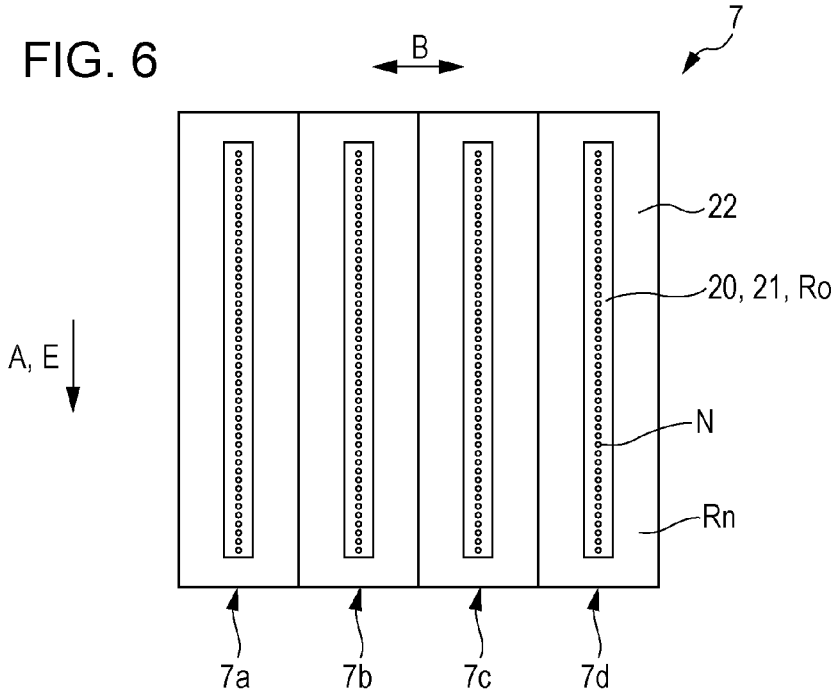
FIG. 6 is a schematic bottom view presenting portions of the recording apparatus of Exemplary Embodiment 1 of the invention.

As presented in FIGS. 5A and 5B and FIG. 6, the recording head 7 in this exemplary embodiment includes a nozzle plate 21 in which the nozzles N are formed and a cover portion 22 that covers at least a portion of a non-nozzle-N-formed region Rn in the nozzle-formed surface 20 of the nozzle plate 21.

Note that the "non-nozzle-N-formed region Rn in the nozzle-formed surface 20" means the entire region in which no nozzle N is formed in the nozzle-formed surface 20. That is, to express it in another way, the recording head 7 of this exemplary embodiment includes the nozzle plate 21 in which the nozzles N are formed and the cover portion 22 that covers at least a portion of the nozzle-formed surface 20 of the nozzle plate 21 without contacting a nozzle N.

Each of the wipers 19 is provided in a back-and-forth movement range Rh and, as presented in in FIG. 5B, is capable of wiping the cover portion 22 without contacting the nozzle-formed surface 20 as the recording head 7 moves back and forth. Concretely, the wipers 19 are able to wipe the cover portion 22 without contacting the nozzle-formed surface 20 because a thickness L2 of a cover region in the cover portion 22 which actually covers the nozzle-formed surface 20 is sufficiently large relative to a length L1 of an exposed region Ro in the nozzle-formed surface 20 which is not covered with the cover portion 22, the length L1 being measured in the reciprocating directions B of the recording head 7.

When the cover portion 22 that covers at least a portion of the non-nozzle-N-formed region Rn in the nozzle-formed surface 20 is provided as in the recording apparatus 1 of this exemplary embodiment, the area of the exposed region Ro becomes small, so that deposit of mist on the nozzle-formed surface 20 can be inhibited or reduced. Furthermore, since the wipers 19 are provided in the back-and-forth movement range Rh of the recording head 7, the mist deposited on the cover portion 22 instead of the nozzle-formed surface 20 can be wiped by the wipers 19 provided in the back-and-forth movement range Rh of the recording head 7 even during recording, without the wipers 19 contacting the nozzle-formed surface 20.

Therefore, the recording apparatus 1 of this exemplary embodiment is capable of cleaning the cover portion 22, without reducing the recording speed, while inhibiting the mist or the like deposited on the nozzle-formed surface 20 from being pushed into the nozzles N. Therefore, the recording apparatus 1 is capable of inhibiting the decline in recording quality due to mist produced as the recording head 7 ejects ink, without reducing the recording speed.

On the other hand, in the related-art recording head 7, as presented in FIG. 8, the thickness L4 of the cover region is small in relation to the length L3 of the exposed region Ro, so that the wipers 19 cannot wipe the cover portion 22 without contacting the nozzle-formed surface 20. Therefore, if wiping is performed during recording, there is a risk that mist or the like deposited on the cover portion 22 or the nozzle-formed surface 20 may be pushed into the nozzles N and therefore the recording quality may decline.

The ratio of the thickness L2 of the cover region to the length L1 of the exposed region Ro is desired to be greater than or equal to 0.02 and less than or equal to 3.0. By setting the ratio to 0.02 or greater, contact of the wipers 19 with the nozzle-formed surface 20 can be effectively inhibited. Furthermore, the distance from the nozzle-formed surface 20 to the recording medium P is set to a short distance in order to maintain a recording quality and inhibit production of mist. Despite this setting, the aforementioned setting of the ratio to 3.0 or less will substantially prevent contact of the cover portion 22 with the recording medium P.

Furthermore, if the ratio of the thickness L2 of the cover region to the length L1 of the exposed region Ro is greater than or equal to 0.5 and less than or equal to 2.4, it is possible to switch between the cleaning in which the wipers 19 wipe without contacting the nozzle-formed surface 20 and the cleaning in which the wipers 19 wipe contacting the nozzle-formed surface 20 by, for example, changing the contact pressure of the wipers 19 on the recording head 7. Therefore, the cleaning can be suitably carried out with ease, for example, if ink is firmly adhered to the exposed region Ro and therefore the cleaning in which the wipers 19 wipe contacting the nozzle-formed surface 20 is desirable.

Note that the recording apparatus 1 of this exemplary embodiment is capable of using black, cyan, magenta, and yellow inks. In the recording head 7 of the exemplary embodiment, as presented in FIG. 6, four recording heads 7*a*, 7*b*, 7*c* and 7*d* that correspond to the black, cyan, magenta, and yellow inks, respectively, and that have substantially the same construction are arranged side by side in the reciprocating directions B. Incidentally, FIGS. 5A and 5B are partial side sectional views that correspond to one of the recording heads 7*a*, 7*b*, 7*c* and 7*d*.

However, this arrangement is not restrictive. For example, a plurality of rows of nozzles that eject a plurality of inks may be arranged in a single nozzle plate 21.

As presented in FIGS. 1 to 3, the recording apparatus 1 of Exemplary Embodiment 1 further includes the transport mechanism 3 that transports the recording medium P in the transporting direction A that intersects the reciprocating directions B of the recording head 7. As presented in FIG. 3, the wipers 19 are provided at end portions 35 of the transport region Rc where the recording medium P is transported by the transport mechanism 3, the end portions 35 being at ends in the reciprocating directions B. That is, the wipers 19 are provided at locations that are within the back-and-forth movement range Rh of the recording head 7 and outside the recording region Rp, so that the wipers 19 can wipe the cover portion 22 without interfering with the recording operation.

More specifically, the wipers 19 in this exemplary embodiment are provided at the two end portions 35 of the transport region Rc where the recording medium P is transported by the transport mechanism 3, the two end portions 35 being at ends in the reciprocating directions B. Therefore, the cover portion 22 can be wiped effectively by the two wipers 19, without interfering with the recording operation.

Furthermore, as mentioned above, the wipers 19 in the exemplary embodiment can be withdrawn from the location at which the wipers 19 are able to wipe the cover portion 22 as the recording head 7 moves back and forth during the recording operation, by the control unit 23 controlling the wiper moving motor 34. That is, when there is no need to wipe the cover portion 22 every time the recording head 7 moves back and forth, it is possible to perform wiping at every predetermined number of back and forth movements of the recording head 7.

If the wipers 19 and the cover portion 22 frequently contact each other, degradation thereof is considered to occur in an early period. However, the recording apparatus 1 of this exemplary embodiment is configured to be able to inhibit the degradation of the wipers 19 and the cover portion 22 due to frequent contacts therebetween.

Furthermore, in this exemplary embodiment, the cover portion 22 are made of a material that has higher liquid repellency to ink than the wipers 19. That is, the cover portion 22 is less easily wetted by ink than the wipers 19 are. Therefore, as the wipers 19 wipe the cover portion 22, the ink on the cover portion 22 (ink mist deposited on the cover portion 22) efficiently moves to the wipers 19.

Incidentally, how to make the cover portion 22 more liquid ink-repellent than the wipers 19 is not particularly limited. Such different liquid repellencies of the cover portion 22 and the wipers 19 to ink may be achieved by, for example, making the cover portion 22 and the wipers 19 from different materials, subjecting the cover portion 22 and the wipers 19 to different surface treatments, etc.

Furthermore, in this exemplary embodiment, the cover portion 22 has been formed so that the liquid repellency to ink is higher at locations near the nozzles N than at locations remote from the nozzles N. Therefore, mist deposited on the cover portion 22 moves more easily from the vicinity of the nozzles N (a region near the nozzle-formed surface 20) toward locations remote from the nozzles N (a region near the side surfaces of the cover portion 22), so that mist is effectively inhibited from being pushed into the nozzles N.

Note that the construction in which the liquid repellency to ink is higher in a region near the nozzles N than in a region remote from the nozzles N includes a construction in which an inner side surface of the cover portion 22 which faces the exposed region Ro and which extends along the direction of the thickness L2 has higher ink repellency than other surfaces of the cover portion 22.

Incidentally, how to make the liquid repellency to ink higher in a region near the nozzles N than in a region remote from the nozzles N is not particularly limited. Such different liquid repellencies to ink may be achieved by, for example, using different materials, employing different surface treatments, etc.

In this exemplary embodiment, the wipers 19 are blade type wipers that contact the cover portion 22 (a member to be wiped) and scrape mist from the cover portion 22. More specifically, the wipers 19 are blades that extend in directions that intersect the reciprocating directions B of the recording head 7. Therefore, the wipers 19 are simple in construction and low in cost. However, such a construction of wipers is not restrictive.

For example, the wipers may be liquid absorption type wipers made of a material capable of absorbing a liquid such as ink or the like, for example, a cloth or the like. A wiper having such a construction can more effectively inhibit mist being pushed into nozzles by the wiper than the blade type wiper.

Figure 7:
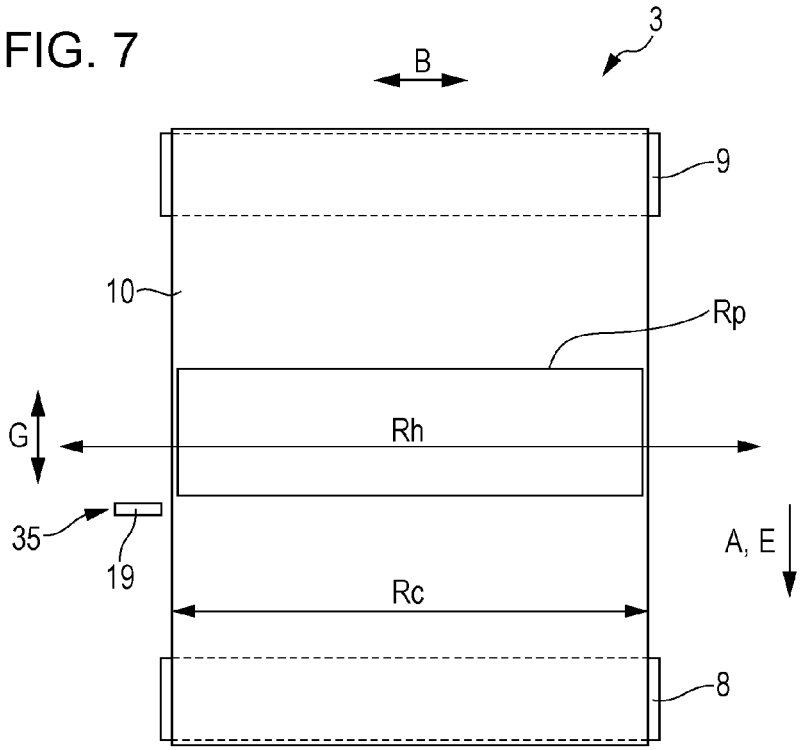
FIG. 7 is a schematic plan view presenting a recording apparatus according to Exemplary Embodiment 2 of the invention.

Exemplary Embodiment 2 (FIG. 7)

A recording apparatus according to Exemplary Embodiment 2 of the invention will be described.

FIG. 7 is a schematic diagram of portions in and around a transport mechanism 3 that transports a recording medium P, with wipers 19 that are portions of the recording apparatus 1 according to Exemplary Embodiment 2 of the invention, corresponding to FIG. 3 presenting portions in and around the transport mechanism 3 of Exemplary Embodiment 1. Incidentally, component members of Exemplary Embodiment 2 comparable to those of Exemplary Embodiment 1 are denoted by the same characters and detailed descriptions thereof are omitted below.

The recording apparatus 1 of this exemplary embodiment is different from the recording apparatus 1 of Exemplary Embodiment 1 only in the construction of the wipers 19.

The wipers 19 in Exemplary Embodiment 1 are blade type wipers that extend along the transporting direction A.

The wipers 19 in Exemplary Embodiment 2, as presented in FIG. 7, blade type wipers that extend in the reciprocating directions B and that are movable in directions G along the transporting direction A. During a period from when the recording head 7 that moves in the reciprocating directions B in a recording operation moves out of the recording region Rp, decelerates, stops, and then begins to move in the opposite direction to when the recording head 7 re-enters the recording region Rp, the wipers 19 can move in the directions G to wipe the cover portion 22 of the recording head 7.

To express this in another way, the recording apparatus 1 of this exemplary embodiment includes the recording head 7 that has a nozzle-formed surface 20 in which nozzles N are arranged in the directions G that intersect the reciprocating directions B and the wipers 19 capable of wiping in the directions G of arrangement of the nozzles N (i.e., the nozzle row directions).

Due to the construction in which the wipers 19 wipe along the nozzle rows, a direction of the length of an exposed region Ro in the nozzle-formed surface 20 which is not covered by the cover portion 22 and a direction of the length of the wipers 19 intersect each other, so that the wipers 19 are less likely to enter the exposed region Ro. In this construction, because the wipers 19 wipe along the direction of the length of the exposed region Ro, the wipers 19 are unlikely to contact the nozzle-formed surface 20 and therefore mist is less likely to be pushed into the nozzles N.

Incidentally, it should be apparent that the invention is not limited by the foregoing exemplary embodiments but can be modified and changed in various manners within the scope of the invention described in the appended claims and that such changes and modifications are encompassed within the scope of the invention.

The invention has been described in detail above with reference to the specific exemplary embodiments. Features of the invention will be briefly recapitulated below.

A recording apparatus 1 according to a first exemplary embodiment of the invention includes a recording head 7 capable of moving back and forth relative to a recording medium P and ejecting a liquid from a nozzle N, a cover portion 22 that covers at least a portion of a no-nozzle-formed region Rn in which the nozzle N is not formed within a nozzle-formed surface 20 in which the nozzle N is formed, and a wiper 19 provided in a back-and-forth movement range Rh of the recording head 7 and capable of wiping the cover portion 22 without contacting the nozzle-formed surface 20 as the recording head 7 moves back and forth.

Note that the "nozzle-formed surface 20" in the "non-nozzle-N-formed region Rn" means the entire region in the nozzle-formed surface 20 in which no nozzle N is formed.

According to this exemplary embodiment, the provision of the cover portion 22 that covers at least a portion of the non-nozzle-N-formed region Rn in the nozzle-formed surface 20 inhibits mist from depositing on the nozzle-formed surface 20. Furthermore, the mist having deposited on the cover portion 22 instead of the nozzle-formed surface 20 can be wiped off even during recording by the wiper 19 provided in the back-and-forth movement range Rh of the recording head 7, without contacting the nozzle-formed surface 20. Therefore, the recording apparatus 1 can clean the cover portion 22 while avoiding reduction in the recording speed and inhibiting mist or the like deposited on the nozzle-formed surface 20 from being pushed into the nozzles N. Hence, the recording apparatus 1 can inhibit the decline in recording quality due to mist produced as the recording head 7 ejects liquid, without reducing the recording speed.

In a recording apparatus 1 according to the second exemplary embodiment of the invention based on the first exemplary embodiment, the cover portion 22 has higher liquid repellency to the liquid than the wiper 19 does.

According to the second exemplary embodiment, the cover portion 22 has higher liquid repellency to the liquid than the wiper 19 does. That is, the cover portion 22 is less easily wetted by the liquid than the wiper 19 is. Therefore, as the wiper 19 wipes the cover portion 22, the liquid on the cover portion 22 (mist deposited on the cover portion 22) will efficiently move to the wiper 19.

A recording apparatus 1 according to a third exemplary embodiment of the invention based on the first or second exemplary embodiment, the liquid repellency of the cover portion 22 to the liquid is higher in a region near the nozzle N than in a region remote from the nozzle N.

According to the third exemplary embodiment, the liquid repellency of the cover portion 22 to the liquid is higher in the region near the nozzle N than in the region remote from the nozzle N. Therefore, mist deposited on the cover portion 22 moves more easily from the region near the nozzle N toward the region remote from the nozzle N, so that mist can be effectively inhibited from being pushed into the nozzle N.

In a recording apparatus 1 according to a fourth exemplary embodiment of the invention based on any one of the first to third exemplary embodiments, the wiper 19 is a blade that extends in a direction that intersects the reciprocating directions B of the recording head 7.

According to the fourth exemplary embodiment, the wiper 19 is a blade extending in a direction that intersects the reciprocating directions B of the recording head 7. Therefore, the wiper 19 can be easily constructed at low cost.

In a recording apparatus 1 according to a fifth exemplary embodiment of the invention based on any one of the first to third exemplary embodiments, in the nozzle-formed surface 20, the nozzle N is arranged in a direction G that intersects reciprocating directions B of the recording head 7. Furthermore, the wiper 19 is capable of wiping along the direction G in which the nozzles N are arranged.

According to the fifth exemplary embodiment, nozzles N are arranged in the nozzle-formed surface 20 in the direction G that intersects the reciprocating directions B of the recording head 7, and wipers 19 can wipe along the direction G in which the nozzles N are arranged. That is, the wiping can be performed along rows of nozzles. This construction makes it possible to easily avoid forming a construction in which the cover portion 22 is wiped by the wiper 19 in a direction that intersects the direction of the length of the exposed region Ro in the nozzle-formed surface 20 which is not covered by the cover portion 22 (a construction in which the wiper 19 is likely to contact the nozzle-formed surface 20). Therefore, a construction in which the wiper 19 is unlikely to contact the nozzle-formed surface 20 can be easily provided, so that a construction in which mist is unlikely to be pushed into the nozzle N can be easily provided.

In a recording apparatus 1 according to a sixth exemplary embodiment of the invention based on any one of the first to third exemplary embodiments, the wiper 19 is made of a material capable of absorbing the liquid.

According to this exemplary embodiment, the wiper 19 is made of a material that can absorb the liquid. Therefore, mist can be effectively inhibited from being pushed into the nozzles N by the wiper 19.

In a recording apparatus 1 according to a seventh exemplary embodiment of the invention based on any one of the first to sixth exemplary embodiments, the wiper 19 is capable of being withdrawn from a location at which the wiper 19 is able to wipe the cover portion 22 as the recording head 7 moves back and forth.

According to this exemplary embodiment, the wiper 19 can be withdrawn from the location at which the wiper 19 can wipe the cover portion 22 as the recording head 7 moves back and forth. Therefore, when there is no need to wipe the cover portion 22 every time the recording head 7 moves back or forth, the recording apparatus 1 can perform wiping at every predetermined number of back and forth movements of the recording head 7. Hence, the degradation of the wipers 19 and the cover portion 22 due to frequent contacts therebetween can be reduced.

In a recording apparatus 1 according to an eighth exemplary embodiment of the invention based on any one of the first to seventh exemplary embodiments, the ratio of the thickness L2 of the cover region in the cover portion 22 which covers the nozzle-formed surface 20 to the length L1 of the exposed region Ro in the nozzle-formed surface 20 which is not covered with the cover portion 22, the length L1 being measured in the reciprocating directions B of the recording head 7, is greater than or equal to 0.02 and less than or equal to 3.0.

According to this exemplary embodiment, the ratio of the thickness L2 of the cover region to the length L1 of the exposed region Ro is greater than or equal to 0.02 and less than or equal to 3.0. By setting the ratio to 0.02 or greater, the wiper 19 can be effectively inhibited from contacting the nozzle-formed surface 20. By setting the ratio to 3.0 or less, contact of the cover portion 22 with the recording medium P can be inhibited even when the distance from the nozzle-formed surface 20 to the recording medium P is a short distance.

In a recording apparatus 1 according to a ninth exemplary embodiment of the invention based on the eighth exemplary embodiment, the ratio of the thickness L2 of the cover region to the length L1 of the exposed region Ro is greater than or equal to 0.5 and less than or equal to 2.4.

According to the ninth exemplary embodiment, the setting of the ratio of the thickness L2 of the cover region to the length L1 of the exposed region Ro to a ratio greater than or equal to 0.5 and less than or equal to 2.4 makes it possible to switch between the cleaning in which the wiper 19 wipes without contacting the nozzle-formed surface 20 and the cleaning in which the wiper 19 wipes contacting the nozzle-formed surface 20 by, for example, changing the contact pressure of the wiper 19 on the recording head 7. Therefore, the cleaning can be suitably carried out with ease, for example, if ink, as the liquid, is firmly adhered to the exposed region Ro and therefore the cleaning in which the wiper 19 wipes contacting the nozzle-formed surface 20 is desirable.

A recording apparatus 1 according to a tenth exemplary embodiment of the invention based on any one of the first to ninth exemplary embodiments further includes the transport portion 3 that transports the recording medium P in a direction A that intersects the reciprocating directions B of the recording head 7 and the wiper 19 is provided at an end portion 35 of the transport region Rc in which the recording medium P is transported by the transport portion 3, the end portion 35 being at an end in one of the reciprocating directions B.

According to the tenth exemplary embodiment, the wiper 19 is provided at an end portion 35 of the transport region Rc in which the recording medium P is transported by the transport portion 3, the end portion being at an end in one of the reciprocating directions B. Therefore, the wiper 19 can wipe the cover portion 22 without interfering with the recording operation.

A recording apparatus 1 according to an eleventh exemplary embodiment of the invention based on the tenth exemplary embodiment, wipers 19 are provided at two end portions 35 of the transport region Rc in the reciprocating directions B.

According to the eleventh exemplary embodiment, the wipers 19 are provided at the two end portions 35 of the transport region Rc in which the recording medium P is transported by the transport portion 3, the end portions 35 being at ends in the reciprocating directions B. Therefore, the cover portion 22 can be wiped effectively by the (two) wipers 19 provided at the two opposite ends, without interfering with the recording operation.

Although in Exemplary Embodiment 1, the wipers 19 extend along the transporting direction A, it is also possible to adopt a construction in which the wipers 19 extend in a direction that intersects the transporting direction A so that the direction of the length of the exposed region Ro and the direction of the length of the wipers 19 intersect each other. Due to this construction, entrance of the wipers 19 into the exposed region Ro can be made less likely, and it is possible to perform the cleaning of the cover portion 22 while inhibiting mist deposited on the nozzle-formed surface 20 from being pushed into the nozzles N.

Although in Exemplary Embodiment 2, the moving directions of the wipers 19 are the directions G along the transporting direction A and the direction of the length of the wipers 19 is along the reciprocating directions B, it suffices that the recording apparatus 1 has a construction in which the direction of the length of the exposed region Ro and the direction of the length of the wipers 19 intersect each other, in order to achieve the advantage of making the wipers 19 less likely to enter the exposed region Ro and therefore accomplishing the cleaning of the cover portion 22 while substantially avoiding pushing into the nozzles N the mist or the like deposited on the nozzle-formed surface 20. For examples, a construction in which the moving direction of the wipers 19 intersects both the transporting direction A and the reciprocating directions B or a construction in which the direction of the length of the wipers 19 intersects both the direction of the length of the exposed region Ro and the reciprocating directions B may be adopted. That is, the recording apparatus 1 does not necessarily need to be constructed to be capable of performing the wiping along the direction G in which the nozzles N are arranged (i.e., the direction of rows of nozzles) in order to achieve the foregoing advantage.

The entire disclosure of Japanese Patent Application No. 2015-014093, filed Jan. 28, 2015 is expressly incorporated by reference herein.

What is claimed is:

1. A recording apparatus comprising:

a recording head capable of moving back and forth relative to a recording medium and ejecting a liquid from a nozzle;

a cover portion that covers at least a portion of a no-nozzle-formed region in which the nozzle is not formed within a nozzle-formed surface in which the nozzle is formed; and a wiper provided in a back-and-forth movement range of the recording head and capable of wiping the cover portion without contacting the nozzle-formed surface by moving the recording head on the wiper in the back and forth direction of the recording head, wherein the wiper is a blade that is elongate in a direction that intersects a reciprocating direction of the recording head.

2. The recording apparatus according to claim 1, wherein the cover portion has higher liquid repellency to the liquid than the wiper does.

3. The recording apparatus according to claim 1, wherein the liquid repellency of the cover portion to the liquid is higher in a region near the nozzle than in a region remote from the nozzle.

4. The recording apparatus according to claim 1, wherein the wiper is a blade that extends in a direction that intersects reciprocating directions of the recording head.

5. A recording apparatus comprising:

a recording head capable of moving back and forth relative to a recording medium and ejecting a liquid from a nozzle;

a cover portion that covers at least a portion of a no-nozzle-formed region in which the nozzle is not formed within a nozzle-formed surface in which the nozzle is formed;

in the nozzle-formed surface, a plurality of the nozzle is arranged in a direction that intersects reciprocating directions of the recording head; and a wiper that is capable of wiping the cover portion, the wiper wiping in a direction that intersects the reciprocating directions of the recording head without contacting the nozzle-formed surface, wherein the wiper is a blade that is elongate in a direction that intersects a reciprocating direction of the recording head.

6. The recording apparatus according to claim 1, wherein the wiper is made of a material capable of absorbing the liquid.

7. The recording apparatus according to claim 1, wherein the wiper is capable of being withdrawn from a location at which the wiper is able to wipe the cover portion as the recording head moves back and forth.

8. The recording apparatus according to claim 1, wherein ratio of a thickness of a cover region in the cover portion which covers the nozzle-formed surface to a length of an exposed region in the nozzle-formed surface which is not covered with the cover portion, the length being measured in reciprocating directions of the recording head, is greater than or equal to 0.02 and less than or equal to 3.0.

9. The recording apparatus according to claim 8, wherein the ratio of the thickness of the cover region to the length of the exposed region is greater than or equal to 0.5 and less than or equal to 2.4.

10. The recording apparatus according to claim 1, further comprising a transport portion that transports the recording medium in a direction that intersects reciprocating directions of the recording head, wherein the wiper is provided at an end portion of a transport region in which the recording medium is transported by the transport portion, the end portion being at an end in one of the reciprocating directions.

11. The recording apparatus according to claim 10, wherein the wiper is provided at each of two end portions of the transport region in the reciprocating directions.

* * * * *